US006269784B1

(12) United States Patent
Newton

(10) Patent No.: US 6,269,784 B1
(45) Date of Patent: Aug. 7, 2001

(54) ELECTRICALLY ACTUABLE ENGINE VALVE PROVIDING POSITION OUTPUT

(75) Inventor: Stephen James Newton, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/559,870

(22) Filed: Apr. 26, 2000

(51) Int. Cl.[7] ..... F01L 9/04

(52) U.S. Cl. ..... 123/90.11; 251/129.01; 251/129.16

(58) Field of Search ..... 123/90.11; 251/129.01, 251/129.1, 129.15, 129.16

(56) References Cited

U.S. PATENT DOCUMENTS

| | | | | |
|---|---|---|---|---|
| 4,690,371 | * | 9/1987 | Bosley et al. | 251/65 |
| 4,829,947 | * | 5/1989 | Lequesne | 123/90.11 |
| 4,848,725 | * | 7/1989 | Tibbals, Jr. | 251/129.02 |
| 5,056,754 | | 10/1991 | Graner et al. | 251/129.16 |
| 5,110,087 | | 5/1992 | Studtmann et al. | 251/129.16 |
| 5,131,624 | | 7/1992 | Kreuter et al. | 251/129.18 |
| 5,222,714 | | 6/1993 | Morinigo et al. | 251/129.16 |
| 5,269,269 | | 12/1993 | Kreuter | 123/90.11 |
| 5,293,551 | * | 3/1994 | Perkins et al. | 361/154 |
| 5,690,064 | | 11/1997 | Izuo | 123/90.11 |
| 5,775,276 | * | 7/1998 | Yanai et al. | 123/90.11 |
| 5,782,211 | * | 7/1998 | Kamimaru | 123/90.11 |
| 5,915,347 | * | 6/1999 | Yanai et al. | 123/90.11 |
| 5,941,201 | | 8/1999 | Shimiza et al. | 123/90.11 |
| 5,954,030 | * | 9/1999 | Sturman et al. | 123/446 |
| 6,176,208 | * | 1/2001 | Tsuzuki et al. | 123/90.11 |

* cited by examiner

*Primary Examiner*—Wellun Lo
(74) *Attorney, Agent, or Firm*—Quarles & Brady LLP

(57) ABSTRACT

A controller for electrically actuated engine valves operates in a switching mode to monitor back EMF during periods when the coil drive current is off. Back EMF is used to determine a position of the armature so as to control the armature current to provide for soft seating of the valve reducing valve wear.

19 Claims, 3 Drawing Sheets

FIG. 1
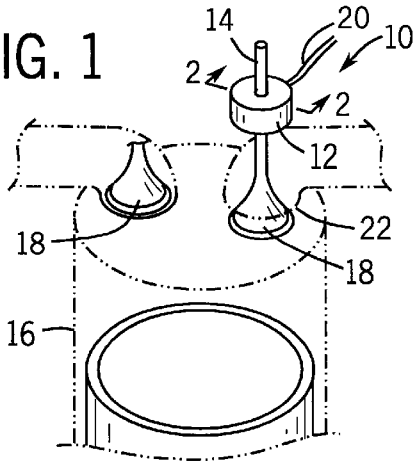
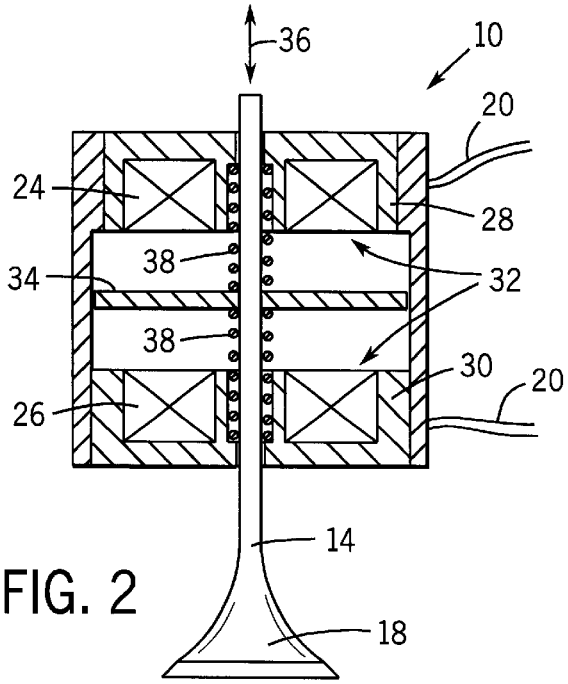
FIG. 2
FIG. 3
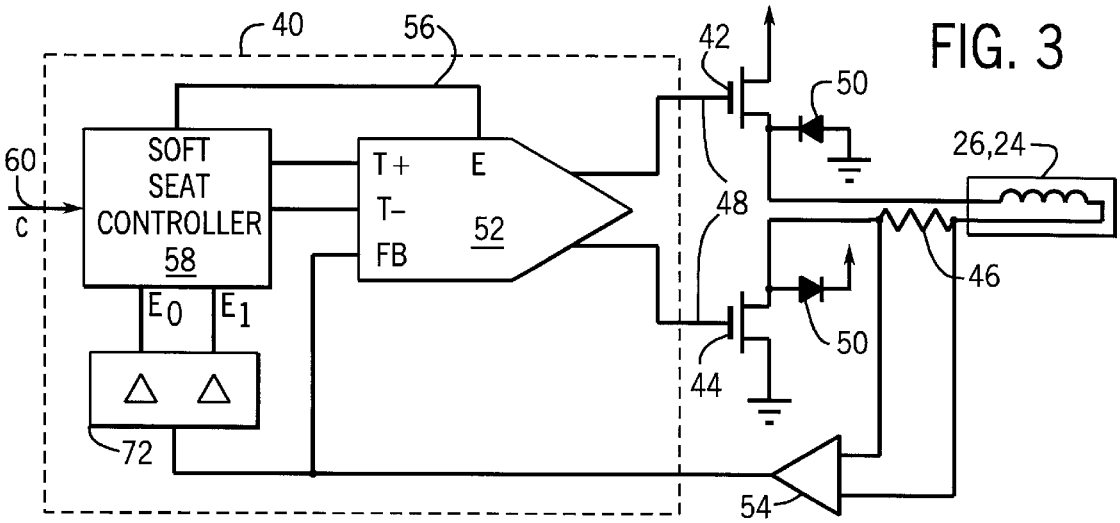

FIG. 6
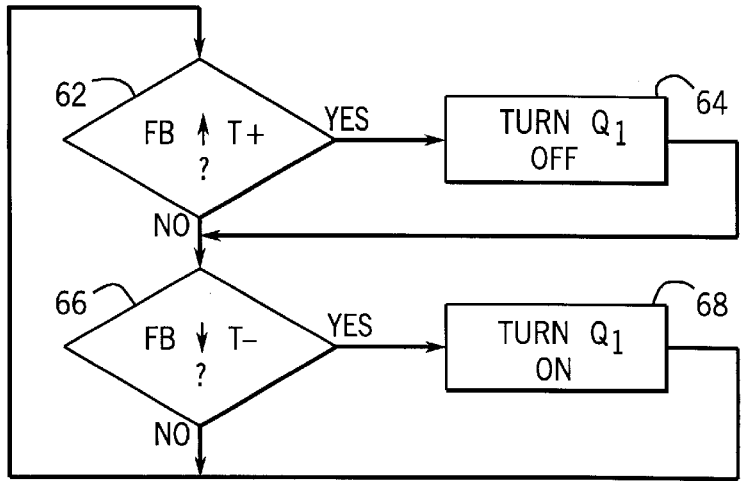
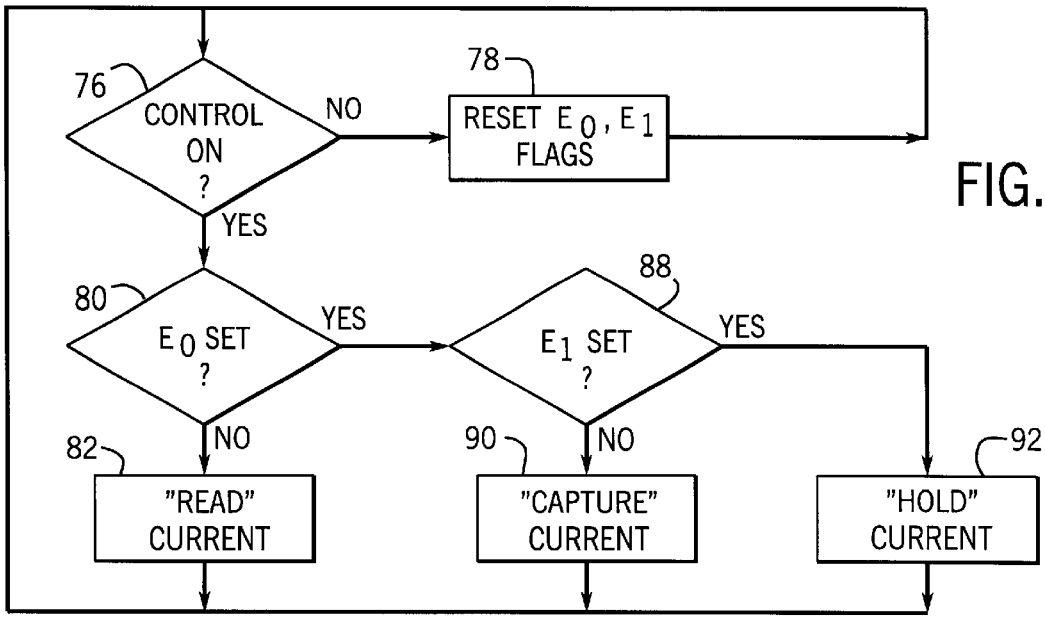
FIG. 7
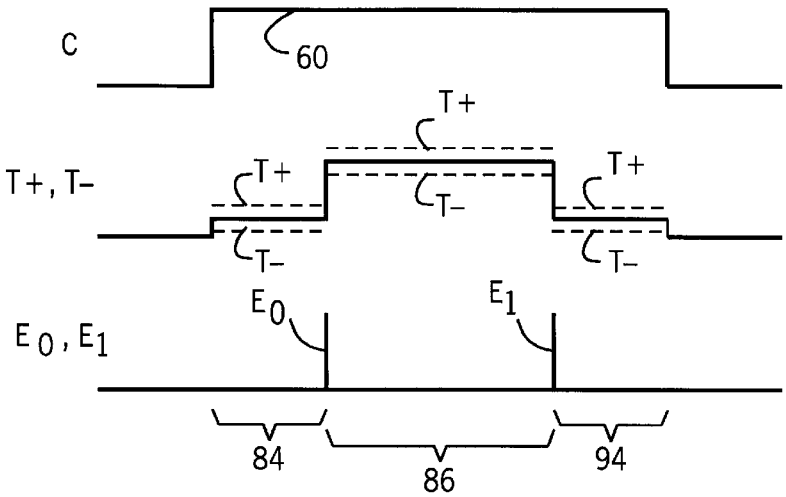
FIG. 8a
FIG. 8b
FIG. 8c

ELECTRICALLY ACTUABLE ENGINE VALVE PROVIDING POSITION OUTPUT

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to actuators for the intake and exhaust valves of internal combustion engines, and specifically to an electronically actuable engine valve providing a signal indicating the valve position.

Electrically actuable valves allow improved engine control. Unlike valves actuated mechanically by cam shafts and the like, the timing on electrically actuable valves can be more freely varied during different phases of engine operation by a computer-based engine controller.

One type of actuator for such a valve provides a disk-shaped armature which moves back and forth between two cylindrical electromagnets. The armature is attached to the valve stem of the valve and is moved against the force of two opposing springs each positioned between the armature and an opposing core. In an unpowered condition, the armature is held in equipoise between the two cores by the opposing spring forces.

During operation, the armature is retained against one of the cores by a "holding" current in the retaining electromagnet. The spring between the armature and the retaining core is compressed while the other spring is stretched.

A change of state is effected, opening or closing the valve, by interrupting the current holding the armature in place. When this occurs, the energy stored in the compressed and stretched springs accelerates the armature off of the releasing core toward the opposing receiving core. When the armature reaches the receiving core, that core is energized with a "holding" current to retain the armature in position against its surface.

In a frictionless system, the armature reaches a maximum velocity at the midpoint between the two cores (assuming equal spring forces) and just reaches the receiving core assembly with zero velocity. In a physically realizable system in which friction causes some of the stored energy of the springs to be lost as heat, the armature will not reach the receiving core unless the energy lost to friction is replaced. This is accomplished by creating a "capture" current in the receiving coil which produces a magnetic force to attract the armature and pull it to the core. The capture current is necessarily initiated before the armature contacts the receiving core. Once the armature is captured by the receiving coil, the current can be reduced to a holding level sufficient to hold the armature against the core until the next transition is initiated.

Capture of the approaching armature requires that the capture current be of sufficient magnitude to draw the armature to the core. However, it is equally important that the speed at which the armature strikes the core be limited to prevent armature damage and/or core damage and to minimize impact noise. During valve closing, control of the capture current is necessary to limit valve-seating velocity and thereby to prevent valve and/or valve seat damage or premature valve wear and to minimize valve-seating noise. If the capturing current is turned on too soon (or is too great in magnitude), the armature may be accelerated into the core and the valve into its seat at excessive velocity. Conversely, the armature may not be captured by the receiving core and the valve may not close if the capture current is turned on too late (or is too low in magnitude). Therefore, it is important to know armature position and velocity as it approaches the receiving core to ensure that the capture current is initiated at the proper time or amount to ensure proper capturing of the approaching armature.

Electronic position sensors may be attached to the valve stem for this purpose. Unfortunately position sensors that are sufficiently accurate and robust enough to survive in the environment of an internal combustion engine are expensive and thus impractical.

BRIEF SUMMARY OF THE INVENTION

The present inventor has recognized that a signal providing an indication of the position of the armature with respect to the cores may be derived from a back electromagnetic force ("back EMF") generated in the receiving coil typically when the receiving coil is energized with a small sensing current. The back EMF is dependent in magnitude on the proximity of the armature to the receiving coil and thus provides an indication of armature position that may be used for more accurate valve actuation or other purposes.

Specifically then, the present invention provides a controller for an electrically actuable engine valve, the valve having an actuation coil producing a magnetic field to attract a movable armature communicating with a valve. The controller includes a current control circuit receiving a valve actuation signal (such as from an engine controller) and a drive current signal to provide current to the actuation coil when the valve actuation signal is present and as a function of the value of the drive current signal. An armature detector senses a back EMF resulting from an approach of the movable armature toward the actuation coil and based on this detection, a soft seat circuit adjusts the drive current signal to the current control circuit as a function of the back EMF sensed by the armature detector.

Thus, it is one object of the invention to provide an electrically actuable valve that produces a position output signal such as may be used to precisely control the actuation current to the valve to reduce wear on the valve assembly. Unlike systems which detect only the time at which the armature strikes the coil, the present invention allows monitoring of the approach of the armature as is necessary for soft seating of the valve against the valve seat.

The current control circuit may provide a hysteretic control, outputting current to the actuation coil if the current through the actuation coil drops below a predetermined low threshold and disconnecting current from the actuation coil if the current rises above a predetermined high threshold.

It is thus another object of the invention to provide an efficient controller allowing monitoring back EMF. Hysteretic control operates in a switched mode to reduce power dissipation and facilitates measurement of the faint back EMF signal during periods when the hysteretic control is not outputting current.

The armature detector may monitor the frequency of the switching of the current control circuit in hysteretic mode.

Thus it is another object of the invention to provide an extremely simple measurement output of armature position. Back EMF affects the decay of current in the actuation coil during periods when the hysteretic control is off thus affecting the frequency of switching of the hysteretic control. This frequency may be readily measured.

Alternatively, the armature detector may directly monitor the rate of change of current in the actuation coil after the current control circuit disconnects current from the actuation coil to measure back EMF.

Thus it is another object of the invention to provide a measurement of back EMF that is independent from the changes in control current that may be desired during different stages of the actuator closure.

The soft seat circuit may be sensitive to a seating level of back EMF from the armature detector occurring upon contact of the armature and the actuation coil. The soft seating circuit may provide a capture drive current signal (producing a capture current in the actuation coil) before the seating level is detected and a holding drive current signal (providing a holding current in the actuation coil) after the seating level is detected wherein the holding current is less than the capture current.

Thus it is another object of the invention to provide ample capture current while significantly decreasing the power consumption of the valve during holding.

The soft seat circuit may also be sensitive to a capture level of back EMF from the armature detector occurring prior to contact of the armature in the actuation coil. The soft seating circuit may provide a sensing drive current signal (providing a sensing current in the actuation coil before the capture level is detected) and a capture drive current signal (providing a capture current in the actuation coil after the capture level is detected) wherein the sensing current is less than the capture current.

Thus it is another object of the invention to provide coil current to the actuation coil prior to the need to provide capture current so as to monitor the position of the armature as may trigger the capture current.

The foregoing and other objects and advantages of the invention will appear from the following description. In the description, reference is made to the accompanying drawings which form a part hereof and in which there is shown by way of illustration a preferred embodiment of the invention. Such embodiment does not necessarily represent the full scope of the invention, however, and reference must be made to the claims herein for interpreting the scope of the invention.

BRIEF DESCRIPTION OF THE DRAWINGS

FIG. 1 is a phantom, fragmentary perspective view of a cylinder head and its valve assembly showing an electromagnet actuator suitable for use with the present invention;

FIG. 2 is a cross-section of the electromechanical actuator of FIG. 1 taken along lines 2—2 showing an armature attached to a valve stem and positioned between two electromagnet coils;

FIG. 3 is a block diagram of the present invention showing circuitry for driving one of the coils of FIG. 2 and for monitoring the current to that coil so as to control soft seating via a soft seat control;

FIG. 6 is a flow chart showing logic of operation of the hysteretic control of FIG. 3;

FIG. 7 is a flow chart showing operation of the soft seat control of FIG. 3 in providing different hold currents to the hysteretic controller; and FIGS. 8(*a*) through 8(*c*) are graphs against time of: (*a*) an engine control input to the soft seat control of FIG. 3, (*b*) threshold voltages provided to the hysteretic controller of FIG. 3 by the soft seat controller and (*c*) back EMF events produced by the current sensor of FIG. 3.

DETAILED DESCRIPTION OF THE INVENTION

Figure 4:
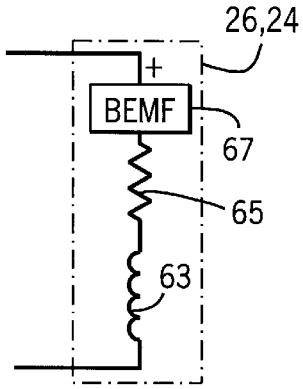
FIG. 4 is a detailed view of the coil of FIG. 3 showing its theoretical decomposition into a back EMF voltage source, a resistance and a coil inductance.

Referring now to FIG. 1, an electro-magnetically actuated valve 10 suitable for use with the present invention provides a coil assembly 12 fitting around a valve stem 14, the latter which may move freely along its axis. The valve stem 14 extends downward from the coil assembly 12 into a piston cylinder 16 where it terminates at a valve head 18. Generally, power applied via leads 20 of the coil assembly 12 will move the valve head 18 toward or away from a valve seat 22 within the cylinder so as to provide for the intake of air and fuel or recirculated exhaust gas, or exhaust of exhaust gas.

Referring now to FIG. 2, the coil assembly 12 provides two toroidal coils 24 and 26 of helically wound electrical wire. The coils 24 and 26 are spaced apart coaxially along the valve stem 14 and fit within cores 28 and 30, respectively, which provide for the concentration of magnetic flux formed when the coils 24 and 26 are energized at opposed open faces 32.

Between the open faces 32 of the cores 28 and 30 is a disk-shaped armature plate 34 attached to the valve stem 14, the surface of the armature plate 34 extending perpendicularly to the axis of the valve stem 14. The space between the open faces 32 is sufficient so that the valve stem 14 may move by its normal range 36 before the armature plate 34 is stopped against either the open face 32 of core 28 or the open face 32 of core 30.

Helical compression springs 38 extend on either side of the armature plate 34 to the cores 28 and 30. Absent the application of current to either of coils 24 and 26, springs 38 bias the armature plate 34 to a point approximately midway between the cores 28 and 30.

Referring now to FIG. 3, power to drive each of the coils 24 or 26 is provided by a pair of solid state switches 42 and 44 activated by a coil driver circuit 40. The configuration of the solid state switches 42 and 44 and coil driver circuit 40 is identical for the two coils 24 and 26 and therefore only one is shown for simplicity.

Solid state switch 42 (when on) connects a source of voltage to one lead of the coil 24 or 26. The other lead of the coil 24 or 26 passes through a sensing resistor 46 and then to the second solid state switch 44 which (when on) provides a path to ground. The switches 42 and 44 are activated by control lines 48. When both switches 42 and 44 are activated by control lines 48, current flows through the associated coil 24 or 26. Free-wheeling diodes 50, known in the art, are attached to the leads of coil 26 and 24 to provide a current path for coil current whenever the solid state switches 44 and 42 are off.

The coil driver circuit 40 provides the signals on control lines 48 and includes a hysteretic controller 52, a soft seat controller 58 and a threshold comparator 72, each which will be described below in more detail. The hysteretic controller 52, soft seat controller 58 and threshold comparator 72 may be implemented as discrete circuitry or by means of a microcontroller programmed as will be described.

In order to produce the signals on control lines 48, the hysteretic controller 52 is provided with a positive threshold signal $T^+$ and a negative threshold signal $T^-$ by a soft seat controller 58. The positive threshold signal $T^+$ and a negative threshold signal $T^-$ indicate generally the desired coil current as will be described. The hysteretic controller 52 also receives an enable signal 56 from a soft seat controller 58 and a feedback signal FB indicating current through the coil 24 or 26 from a current sensing amplifier 54 attached to the current sensing resistor 46. The current sensing amplifier 54 may be a differential amplifier of conventional design.

Referring to FIGS. 3 and 6, a program operating the hysteretic controller 52 begins at decision block 62 immediately after an enable signal 56 is received (not shown). At decision block 62, the hysteretic controller 52 determines whether the feedback signal FB indicating coil current has risen across the positive threshold value $T^+$. If so, then the hysteretic controller 52 proceeds to process block 64 and solid state switch 42 (and/or solid state switch 44) is turned off.

Next, and regardless of the outcome of decision block 64 at decision block 66, the hysteretic controller 52 checks the feedback signal FB to see if it has fallen across the minus threshold $T^-$. If so, at process block 68, solid state switch 42 (and/or solid state switch 44) is turned on. Because the solid-state switches 42 and 44 are operated either fully on or fully off, relatively little power is dissipated by the solid-state switches 42 and 44.

Figure 5A:
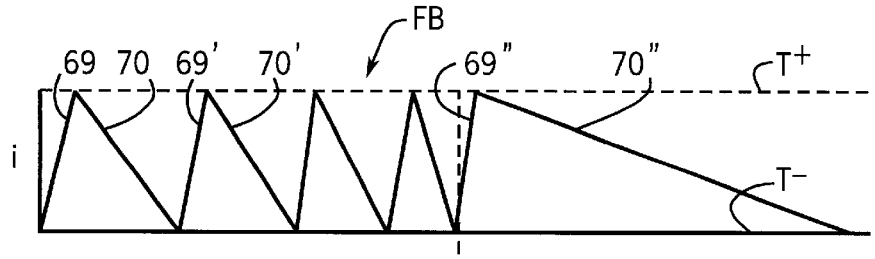
FIGS. 5(*a*) through 5(*c*) are graphs against time of: (*a*) coil current of the coil of FIG. 3, (*b*) frequency of operation of the hysteretic supply of FIG. 3 and (*c*) distance of the armature of FIG. 2 from the attracting coil of FIG. 3.

The hysteretic controller 52 repeats the above steps as long as the enable signal 56 is present to produce in coil 24 or 26, a sawtooth current waveform similar to that shown in FIG. 5*a*. At process block 68, as the voltage is connected to the coil 24 or 26, the current rises in the coil 24 or 26 (limited in rate by the inductance of the coil 24 or 26) until it rises past the positive threshold $T^+$. At process block 64, the current in coil 24 or 26 falls as the voltage is disconnected from the coil 24 or 26 (again limited in rate by the inductance of the coil 24 or 26) until it falls below the negative threshold $T^-$. The separation of thresholds $T^+$ and $T^-$ establish a deadband in between which the current may fluctuate while the average of thresholds $T^+$ and $T^-$ determine the current to the coils 24 or 26. As used herein, the terms "average current" and "current" will be used synonymously reflecting the fact that they are equivalent from the point of view of power applied to the coils 24 or 26.

Referring now to FIG. 4, coils 26 and 24 are electrically equivalent to a series connected pure inductor 63, a pure resistor 65 and perfect voltage source 67 having a voltage proportional to a back EMF from the armature plate 34. The back EMF is caused by current induced in the armature plate 34 according to well-known principles and is of a polarity to oppose the current flowing through the coils 24 or 26.

Referring now to FIG. 5(*a*), when the hysteretic controller 52 first activates solid state switch 42 and the armature plate 34 is far from the receiving coils 24 or 26, the back EMF is low. At this time, the current in the coils 24 or 26 rapidly increases as shown by upward slope 69 under the influence of the relatively large battery voltage. When the $T^+$ threshold is reached, the hysteretic controller turns off switch 42 causing a slower decay in the current in the coil 24 or 26 indicated by falling slope 70. The decay of falling slope 70 is slower than the rising slope 69 because of the relatively low resistance of the coil 26 and 24.

When the current level reaches the $T^-$ threshold, the hysteretic controller 52 again turns on switch 42 causing a second rising slope 69' substantially equal to 69. The back EMF is higher at this time because the armature plate 34 will have moved closer to the coil 24 or 26, however, the battery voltage is so much greater that the back EMF, the slope is essentially unaffected. At the falling slope 70', however, the increased back EMF will be apparent and the slope 70' will fall more quickly as the back EMF fights the current in the coil 26 and 24.

With subsequent cycles, the falling slope 70 becomes progressively steeper until at time $t_0$, the armature strikes the core 30 or 32 of the coil which is being activated and the armature motion stops. At this point, the falling slope 70" decreases abruptly as a result of the cessation of the back EMF.

Generally, the back EMF will be a function of movement of the armature plate 34 and the proximity of the armature plate 34 to the coil at which the back EMF is being detected. Nevertheless, despite this dual dependency, the back EMF provides a good approximation to the separation distance between the armature plate 34 and a given coil 26 as a result of the consistency in acceleration curves of the armature plate 34 in normal use. The soft seat controller 58 uses a measurement of the back EMF to adjust the current in the coil 24 or 26.

Referring again to FIG. 3, the soft seat controller 58 generates the enable signal 56 from an engine control signal on control line 60 indicating that one of the valves 10 needs to be opened or closed. Generally a control signal on control line 60 for one coil 26 will be the opposite of control signal on control line 60 for the other control coil 24. The soft seat controller 58 further generates thresholds $T^+$ and $T^-$ from event triggers $E_0$ and $E_1$ from the threshold comparator 72 such as reflects back EMF from the feedback current signal as will be described.

Figure 5B:
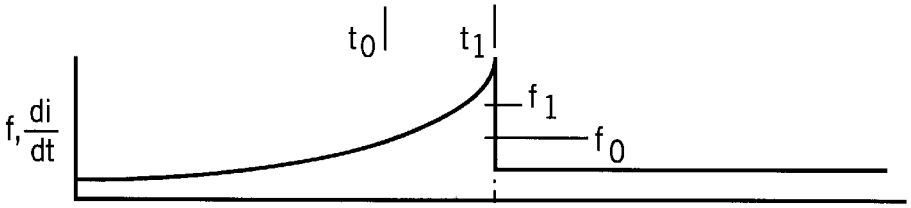
Figure 5C:
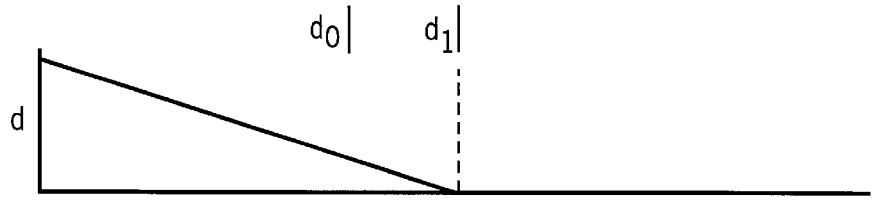

Referring now to FIGS. 5*a*–5*c* it will be seen that both the frequency of the feedback signal (current in the coil 24 or 26) as shown in FIG. 5*b*, and the slope of falling slopes 70 through 70", shown in FIG. 5*c*, can be used as an indication of armature position d. A first and second frequency threshold $f_0$ and $f_1$ may be established to indicate the time $t_1$ when the armature plate 34 has contacted the coil and the time $t_0$ preceding time $t_1$ when the armature plate 34 is still in motion toward its respective core 28 or 30. This former time $t_0$ may be used to control the initiation of the capture current so as to provide just sufficient energy to cause capture of the armature plate 34 without undue acceleration against the core face or in the valve head 18 against the valve seat 22.

Referring to FIG. 3, the threshold comparator 72 may operate in a first embodiment to measure the current (FB) provided by current sensing amplifier 54 to produce two event signals $E_0$ and $E_1$ corresponding generally to $t_0$ and $t_1$ or a distance $d_0$ and $d_1$ as shown in FIG. 5*c* indicating, respectively, a distance and time at which capture current should be initiated and a distance and time at which the armature plate 34 contacts the core. These signals may be produced by a monitoring of the frequency FB or the slopes 70 as have been described above. Thus the comparator 72 may be a differentiater to provide a di/dt signal (of slopes 70) or a frequency counter as are well known in the art.

Referring now to FIGS. 7 and 8*a* through 8*c*, and FIG. 3, the soft seat controller 58 first monitors the control line 60 to determine whether actuation of the respective coil 24 or 26 should be performed as indicated by decision block 76. The turning on of the control signal on control line 60 is shown in FIG. 8*a*.

If the control signal is OFF, then at process block 78, flags monitoring signal $E_0$ and $E_1$ are reset and the program returns to decision block 76. If at decision block 76, the control signal is ON, then the program proceeds to process block 80 to determine whether the $E_0$ flag has been set indicating that the $E_0$ event has occurred.

Assuming for the moment that event $E_0$ has not yet occurred, then the $E_0$ flag is not set and the program proceeds to process block 82 and a "read" current is established in the coil 24 or 26. This is done by establishing thresholds T+ and $T^-$ at a relatively low amount of current as indicated in time period 84. The current level of the read current is sufficient to detect back EMF but will generally be less than the capture current.

If at decision block 80, the $E_0$ flag is set such as will be the case in time period 86 after event $E_0$, then the program proceeds to decision block 88 where it is determined whether the $E_1$ flag has been set or not.

If not as will be the case in time period 86, then the program proceeds to process block 90 and the capture current is established by thresholds $T^+$ and $T^-$. These thresholds, provided to the hysteretic controller 52 produce a higher value than the read current in time period 84. Upon the occurrence of event $E_1$ at decision block 88, the program proceeds to process block 92 and in time period 94, a holding current is established being generally lower than the capture current of time period 86.

The above description has been that of a preferred embodiment of the present invention, it will occur to those that practice the art that many modifications may be made without departing from the spirit and scope of the invention. For example, a separate coil may be used to provide the read current or the detection of back EMF although at the cost of additional parts. Further, instead of adjusting the magnitude of the capture current, the soft seat controller may adjust the timing of $E_0$. In order to apprise the public of the various embodiments that may fall within the scope of the invention, the following claims are made.

I claim:

1. A controller for an electrically actuable engine valve, the valve having an actuation coil producing a magnetic field to attract a movable armature communicating with a valve head; the controller comprising:

a current control circuit receiving a valve actuation signal and a drive current signal to provide current to the actuation coil when the valve actuation signal is present and as a function of the drive current signal;

an armature detector sensing a back EMF resulting from an approach of the movable armature toward the actuation coil; and a soft seat circuit adjusting the drive current signal to the current control circuit during the approach of the armature toward the actuation coil wherein the drive current signal is a function of the back EMF sensed by the armature detector.

2. The controller of claim 1 wherein the soft seat circuit adjusts at least one of the group consisting of the timing of the drive current signal and the magnitude of the drive current signal.

3. The controller of claim 1 wherein the armature detector includes a current sensor attached to the actuation coil to sense the current therein and wherein the back EMF is derived from a measurement of the current through the actuation coil.

4. The controller of claim 2 wherein the current sensor is a resistor attached in series with the actuation coil.

5. The controller of claim 1 including further a current sensor sensing current in the actuation coil and wherein the current control circuit provides a hysteretic control connecting voltage to the actuation coil if the current drops below a low threshold and disconnecting current from the actuation coil if the current rises above a high threshold.

6. The controller of claim 5 wherein the armature detector monitors the frequency of the switching of the current control circuit between a connecting of voltage to the actuation coil and a disconnecting of voltage to the actuation coil to measure back EMF.

7. The controller of claim 5 wherein the armature detector monitors the rate of change of current in the actuation coil after the current control circuit disconnects voltage from the actuation coil to measure back EMF.

8. The controller of claim 1 wherein the soft seat circuit is sensitive to a seating level of back EMF from the armature detector occurring upon a contact of the armature and the actuation coil, the soft seating circuit providing a capture drive current signal providing a capture current in the actuation coil before the seating level is detected and a holding drive current signal providing a holding current in the actuation coil after the seating level is detected, wherein the holding current is less that the capture current.

9. The controller of claim 8 wherein the soft seat circuit is sensitive to a capture level of back EMF from the armature detector occurring prior to contact of the armature and the actuation coil, the soft seating circuit providing a reading drive current signal providing a reading current in the actuation coil before the capture level is detected and a capture drive current signal providing a capture current in the actuation coil after the capture level is detected, wherein the reading current is less that the capture current.

10. An electronically actuable engine valve comprising:

a valve having a stem extending along an actuation axis;

a first and second actuation coil coaxially positioned about the stem to provide a gap therebetween;

an armature attached to the stem and positioned within the gap;

at least one current control circuit receiving a valve actuation signal and a drive current signal to provide current to a given actuation coil when the valve actuation signal is present and in proportion to the value of the drive current signal;

an armature detector sensing a back EMF resulting from an approach of the armature toward the given actuation coil; and a soft seat circuit providing the drive current signal to the current control circuit wherein the drive current signal is a function of the back EMF sensed by the armature detector.

11. A method of controlling an engine valve having an electrically conducting actuation coil producing a magnetic field to attract a movable armature communicating with the valve the method comprising the steps of:

(a) sensing a back EMF resulting from an approach of the movable armature toward the actuation coil;

(b) generating a drive current signal decreasing as a function of increasing back EMF sensed by the armature detector during approach of the armature; and (c) generating a current to the actuation coil in response to a valve actuation signal, the average current in proportion to the value of the drive current signal.

12. The method of claim 11 wherein the soft seat circuit adjusts at least one of the group consisting of the timing of the drive current signal and the magnitude of the drive current signal.

13. The method of claim 11 wherein step (a) senses the current in the actuation coil and wherein the back EMF is derived from a measurement of the current through the actuation coil.

14. The method of claim 13 wherein the sensing of the current measures a voltage drop across a resistor attached in series with the actuation coil.

15. The method of claim 11 including wherein step (a) senses current in the actuation coil and wherein step (c) provides a hysteretic control connecting voltage to the actuation coil if the current drops below a low threshold and disconnecting voltage from the actuation coil if the current rises above a high threshold.

16. The method of claim 15 wherein sensing the back EMF of step (a) is done by monitoring the frequency of the switching between connecting and disconnecting the voltage to the actuation coil.

17. The method of claim 15 wherein the sensing of back EMF of step (a) is done by monitoring the rate of change of current in the actuation coil current when the voltage is disconnected from the actuation coil.

18. The method of claim 11 wherein the generation of current in the actuation coil is dependent on detection of a seating level of back EMF from the armature occurring upon a contact of the armature and the actuation coil, and wherein a capture current is generated in the actuation coil before the seating level is detected and a holding current is generated in the actuation coil after the seating level is detected, wherein the holding current is less that the capture current.

19. The method of claim 18 wherein the generation of current in the actuation coil is further dependent on a capture level of back EMF from the armature detector occurring prior to contact of the armature and the actuation coil, and wherein a reading current is generated in the actuation coil before the capture level is detected and a capture current is generated in the actuation coil after the capture level is detected, wherein the reading current is less that the capture current.

* * * * *